US007428801B2

(12) United States Patent
Ostenfeldt

(10) Patent No.: US 7,428,801 B2
(45) Date of Patent: Sep. 30, 2008

(54) CEILING STRUCTURE WITH CURVED SHEETS AND A METHOD OF MOUNTING SUCH A CEILING STRUCTURE

(75) Inventor: Johnny Ostenfeldt, Odense (DK)

(73) Assignee: DAMPA ApS (DK)

( * ) Notice: Subject to any disclaimer, the term of this patent is extended or adjusted under 35 U.S.C. 154(b) by 809 days.

(21) Appl. No.: 10/816,285

(22) Filed: Apr. 1, 2004

(65) Prior Publication Data

US 2004/0244323 A1 Dec. 9, 2004

Related U.S. Application Data

(63) Continuation of application No. PCT/DK02/00643, filed on Sep. 30, 2002.

(30) Foreign Application Priority Data

Oct. 1, 2001 (DK) ..... 2001 01431
Apr. 17, 2002 (DK) ..... 2002 00566

(51) Int. Cl.
*E04B 1/82* (2006.01)

(52) U.S. Cl. ..... 52/144; 52/222; 52/764; 52/506.06; 52/506.08; 52/650.3

(58) Field of Classification Search ..... 52/222, 52/506.01, 506.06, 506.08, 506.09, 762, 52/764, 773, 781, 650.3, 144, 145, 28; 181/210, 181/284; 362/342, 352; 40/617
See application file for complete search history.

(56) References Cited

U.S. PATENT DOCUMENTS

| | | | | |
|---|---|---|---|---|
| 3,390,495 | A | 7/1968 | Dalby | |
| 3,394,506 | A * | 7/1968 | Thompson | 52/80.1 |
| 3,780,286 | A * | 12/1973 | Alexieff et al. | 52/28 |
| 4,471,596 | A * | 9/1984 | Deaton et al. | 52/28 |
| 5,128,850 | A * | 7/1992 | Juodvalkis | 362/352 |
| 5,265,333 | A | 11/1993 | Lim et al. | |
| 6,374,564 | B1 * | 4/2002 | Fletterick et al. | 52/506.07 |
| 6,467,228 | B1 * | 10/2002 | Wendt et al. | 52/506.07 |
| 6,834,467 | B2 * | 12/2004 | Gulbrandsen et al. | 52/506.06 |
| 2003/0208938 | A1 * | 11/2003 | Cink et al. | 40/617 |

FOREIGN PATENT DOCUMENTS

EP 0278448 8/1988

* cited by examiner

*Primary Examiner*—Richard E. Chilcot, Jr.
*Assistant Examiner*—Matt J Smith
(74) *Attorney, Agent, or Firm*—Altera Law Group, LLC

(57) ABSTRACT

The invention relates to a ceiling structure comprising a number of sheets that span between parallel beams mounted underneath a fixed ceiling, wherein the sheets can, by elastic deformation, be taken from an initial configuration to a desired curved configuration, in which the sheets form the visible ceiling face. The ceiling structure comprising force-transmitting means that provide, in combination with the abutment force of the sheets against the abutment areas, the flexular moment necessary for maintaining the desired curved configuration of the sheets.

15 Claims, 9 Drawing Sheets

Fig. 3
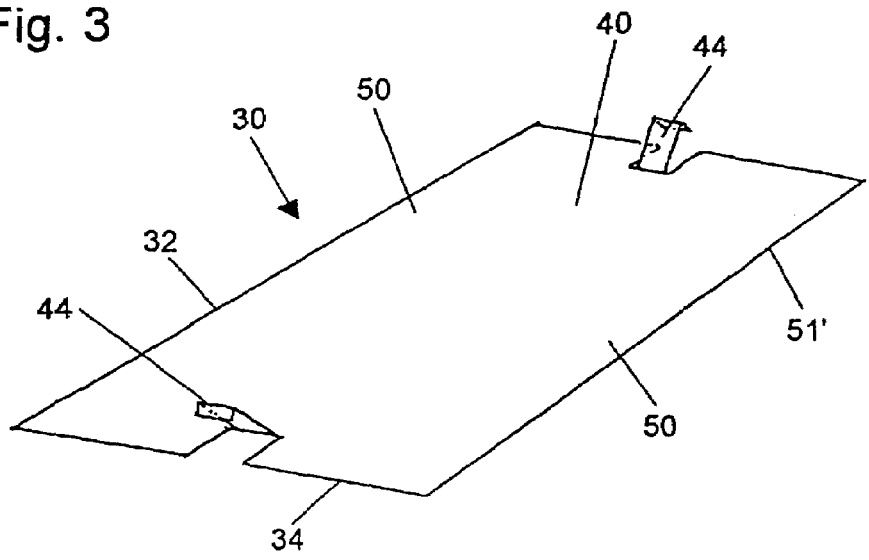
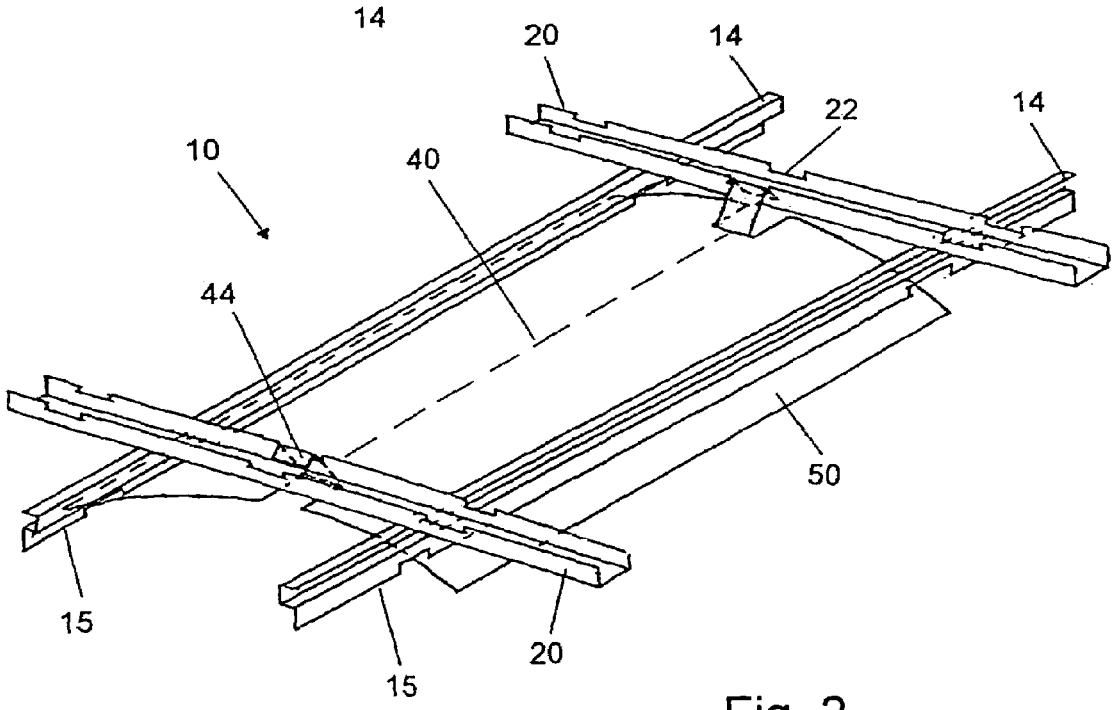
Fig. 2

44
40
51'
50
30
44''
44'
44'''
34
44'
44'
44'''
30

CEILING STRUCTURE WITH CURVED SHEETS AND A METHOD OF MOUNTING SUCH A CEILING STRUCTURE

CROSS-REFERENCE TO RELATED APPLICATIONS

The present application is a continuation of PCT/DK02/00643 filed Sep. 30, 2002, which claims priority from Denmark Patent Application Nos. PA 2002 00566, filed Apr. 17, 2002 and PA 2001 01431, filed Oct. 1, 2001.

The present invention relates to a ceiling structure comprising a number of sheets that span between parallel beams mounted underneath a fixed ceiling, wherein said elements can, by elastic deformation, be changed from an initial configuration to a desired curved configuration, in which the elements are intended to form the visible ceiling face, and wherein the elements have a first expanse along the beams and a transverse, second expanse, in which the elements in said first expanse have edge portions configured for abutment on abutment areas on the beams. Examples of such ceiling structures will appear from European patent application No. 278,448 and U.S. Pat. No. 3,390,495.

It is the object of the invention to facilitate the work involved in the mounting of flexible sheets, while simultaneously providing a ceiling structure that can be constructed by means of relatively simple constructive elements, including beams and boards that do not require a complex and expensive initial processing with a view to providing particular shapes of profile necessary for securing the boards in the curved configuration. It is a further object of the invention to obviate the need for particular mounting tools, since the mounting of the boards is to be accomplished manually.

These and other objects of the invention are obtained in that the ceiling structure also comprises force-transmitting means that are configured to cooperate with parts of the sheets that are arranged between said edge portions in order to provide, in combination with the abutment force of the sheets against the abutment area, the flexural moment necessary for maintaining the desired curved configuration of the sheets.

The invention will now be explained in further detail with reference to a number of embodiments shown in the drawing.

FIG. 2 shows a sectional view of the ceiling structure shown in FIG. 1;

FIG. 3 shows a sheet that forms a part of the visible ceiling face in the ceiling structure shown in FIG. 1;

Figure 1:
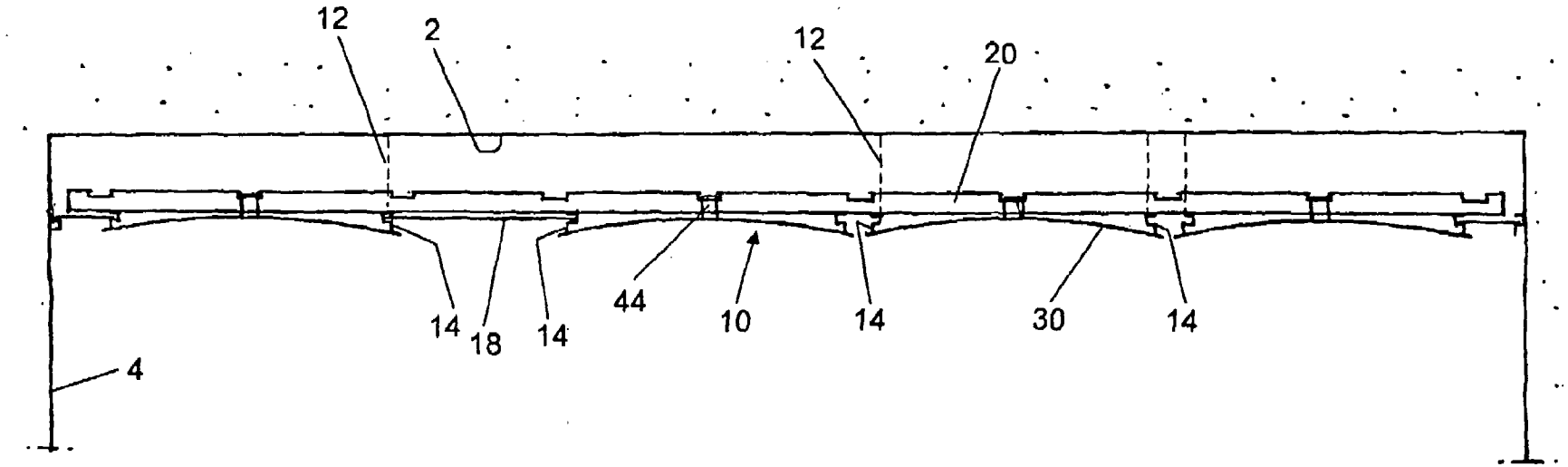
FIG. 1 shows a building room with a ceiling structure in accordance with the invention.

FIG. 1 shows a part of a building room with a fixed ceiling 2, eg a concrete top slab, and having vertical sidewalls 4. At a desired distance below the fixed ceiling 2, a number of carrier elements 12 enable suspension of a false ceiling structure 10 in accordance with the invention.

The ceiling structure 10 comprises a number of parallel beams 14 that are carried by the carrier elements 12 and that extend along the sidewalls 4. In addition, the ceiling construction 10 preferably comprises a further system of parallel beams 20 that extend perpendicular to the first-mentioned beams 14.

The beams 14 and the optional further beams 20 carry between them a number of relatively thin sheet- or plate-like elements 30 that curve upwards and form the ceiling face visible from below, from inside the building room. The ceiling structure 10 can be configured locally to also comprise planar or curved, rigid sheets 18 that do not constitute a part of the invention.

FIG. 2 shows a sectional view of the ceiling structure shown in FIG. 1, and it will appear that the further system of beams 20 is secured to the top face of the beams 14. The beams 14, 20 may have any cross sectional shape. What matters is merely that, along their underside, the beams comprise abutment areas 15 for edge portions 50 of each sheet 30. The ceiling structure 10 also comprises force-transmitting means 22 that are, in the example shown, configured as integral parts of the beams 20 and are arranged in areas between the beams 14, preferably halfway between the beams 14.

FIG. 3 shows an example of a thin sheet or plate-like element 30 that is a constituent of the ceiling structure 10, shown in further detail. The sheet 30 is rectangular, the length of the sheet defining a first expanse of the sheet 30, while the width of the sheet defines a transverse, second expanse of the sheet 30. The board 30 has a central area 40 and edge portions 50 along said first expanse. The sheet 30 has, along its end portions 34, hook-like devices 44 in the form of board sections that are formed by incisions into the sheet, and that have subsequently been folded upwards. The width of the sheet 30 is larger than the distance between two adjacent beams 14, whereas the length of the sheet corresponds approximately to the mutual distance between the force-transmitting means 22 shown in FIG. 2.

The sheets 30 are relatively thin and can, by elastic deformation, be taken from a preferably essentially planar initial configuration, as shown in FIG. 3, to the curved, upwardly arching configuration shown in FIGS. 1 and 2. Prior to mounting, the sheets 30 can thus easily and with modest requirements to space be transported from the site of manufacture to the site of mounting within the building room. They may eg be steel sheets of a thickness of 0.5 mm. When there is a distance between the beams 14 of about 530 mm, a height of arch of about 35 mm is thus provided.

Mounting of a sheet 30 is carried out in an extremely simple manner, as the fitter merely shifts the top face of the edge portions 50 upwards to simultaneous abutment on the abutment areas 15 of two adjacent beams 14. Then he presses the central area 40 of the sheet 30 upwards with his hands, until the hook-like devices 44 engage with the force-transmitting means 22 that may, as mentioned, be configured as integral parts of the beams 20. Hereby the sheet 30 is secured with the desired curvature, depending on the location in the vertical direction of the site of engagement between the force-transmitting means 22 and the hook-like devices 44 relative to the abutment areas 15.

It will be understood that the hook-like devices 44 are preferably configured with a certain resilience, whereby the engagement with the power transmitting means 22 can be provided by a snap-effect.

Following mounting of the first sheet 30, the construction of the visible ceiling face continues by mounting boards elements 30 next to and along the sheet 30 that was first mounted.

In order to dismount one or more of the sheets 30, the slot between the end edges 34 of two adjoining sheets 30 at the hook-like devices 44 may receive a suitable tool for releasing the snap-engagement between the hook-like means 44 and the force-transmitting means 22. It is also an option that the snap-engagement can be released exclusively by one's fingers.

Figure 4A:
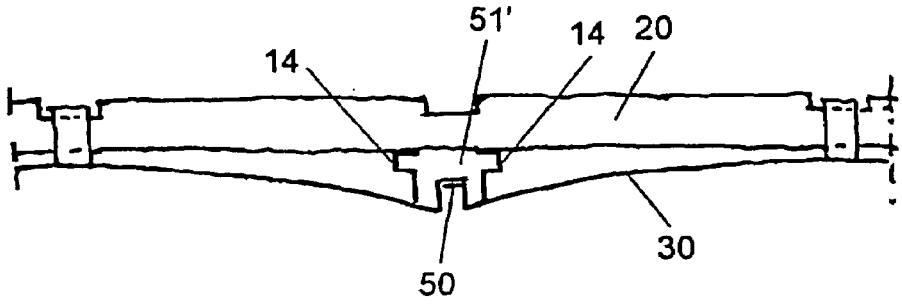
FIGS. 4A and 4B show alternative embodiments of the sheet shown in FIG. 3.
Figure 4B:
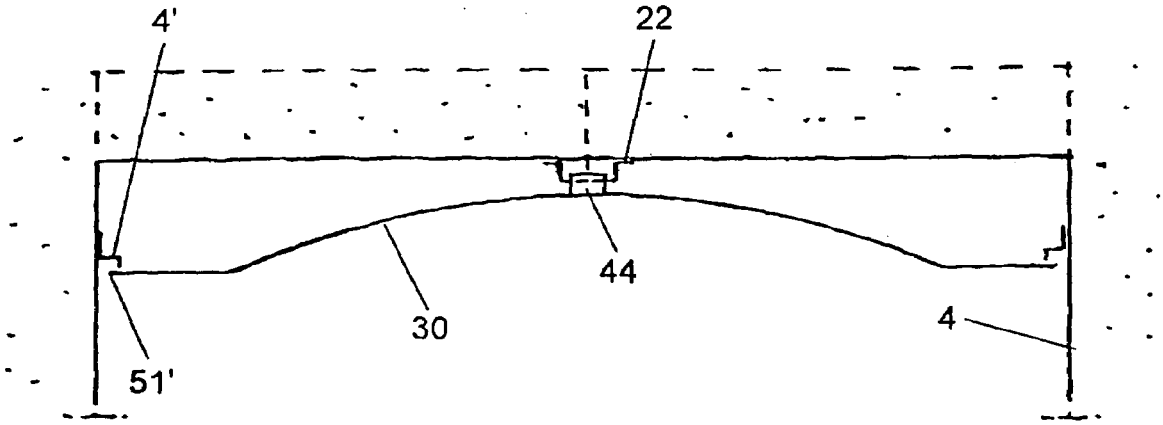

According to an alternative configuration of the sheets 30, in which the sheets—when viewed in the initial configuration—have a central planar area 40, the sheets may have been folded along the outermost edges 51' of the sheets, as sown in FIG. 4A. Hereby it is possible to provide a relatively close fitting of two adjacent sheets, either by the sheets overlapping or by the outermost edges 51' of the sheets 30 abutting on each other. By the configuration shown in FIG. 4B, the sheets are folded in such a manner as to allow the edges 51' of the sheets to closely adjoin mounting ledges 4' on the building wall 4. The shown solution is well suited when the sheets 30 are to form the visible ceiling face in corridors.

Figure 5:
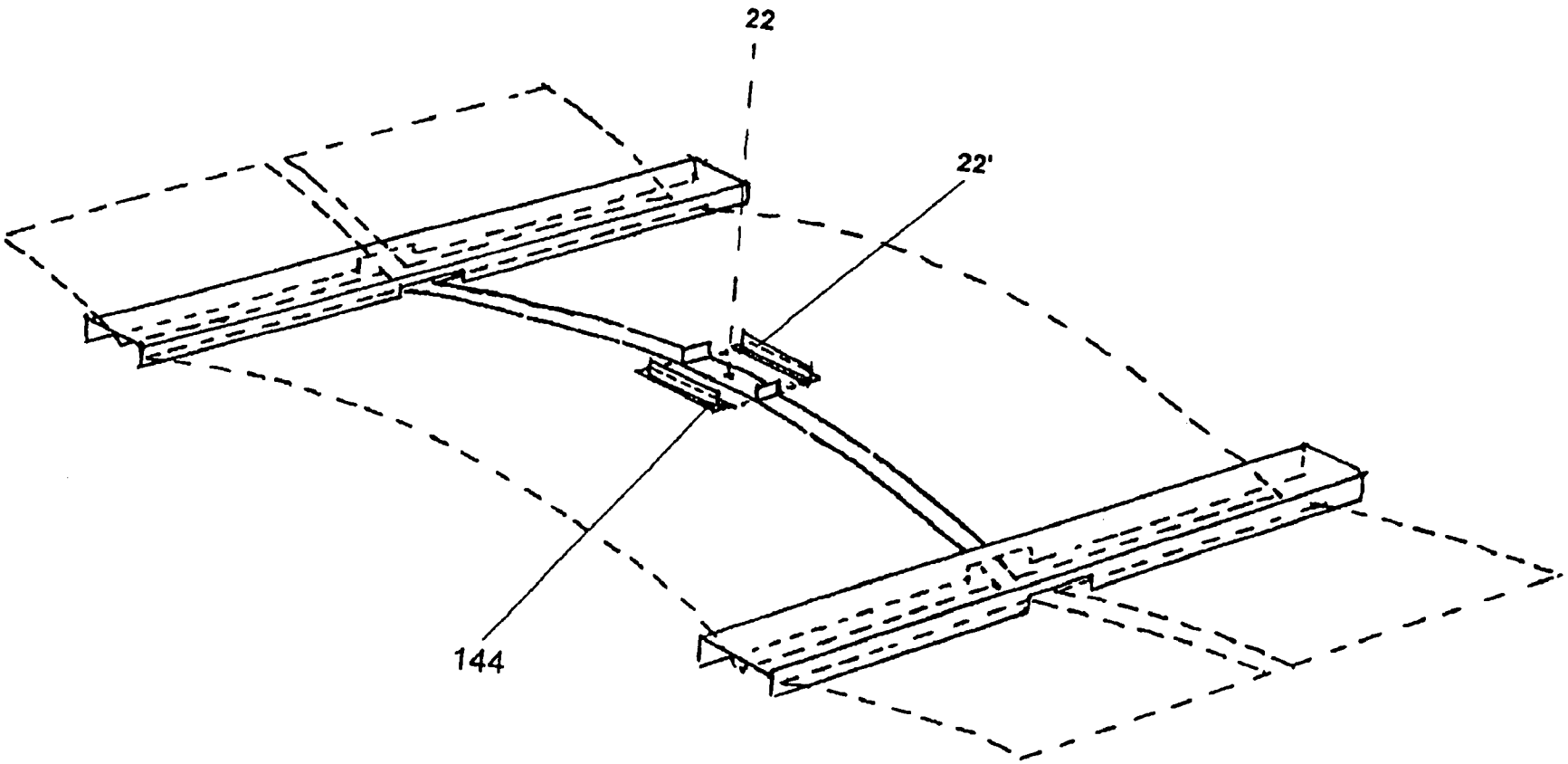
FIG. 5 shows a further alternative embodiment of the sheet shown in FIG. 3.

FIG. 5 shows an alternative configuration of the sheets 30, wherein the sheets 30 have, at their end edges 34, throughgoing openings 144 that cooperate with the force-transmitting means 22, eg via removable fittings 22' that engage with the openings 144.

Figure 6:
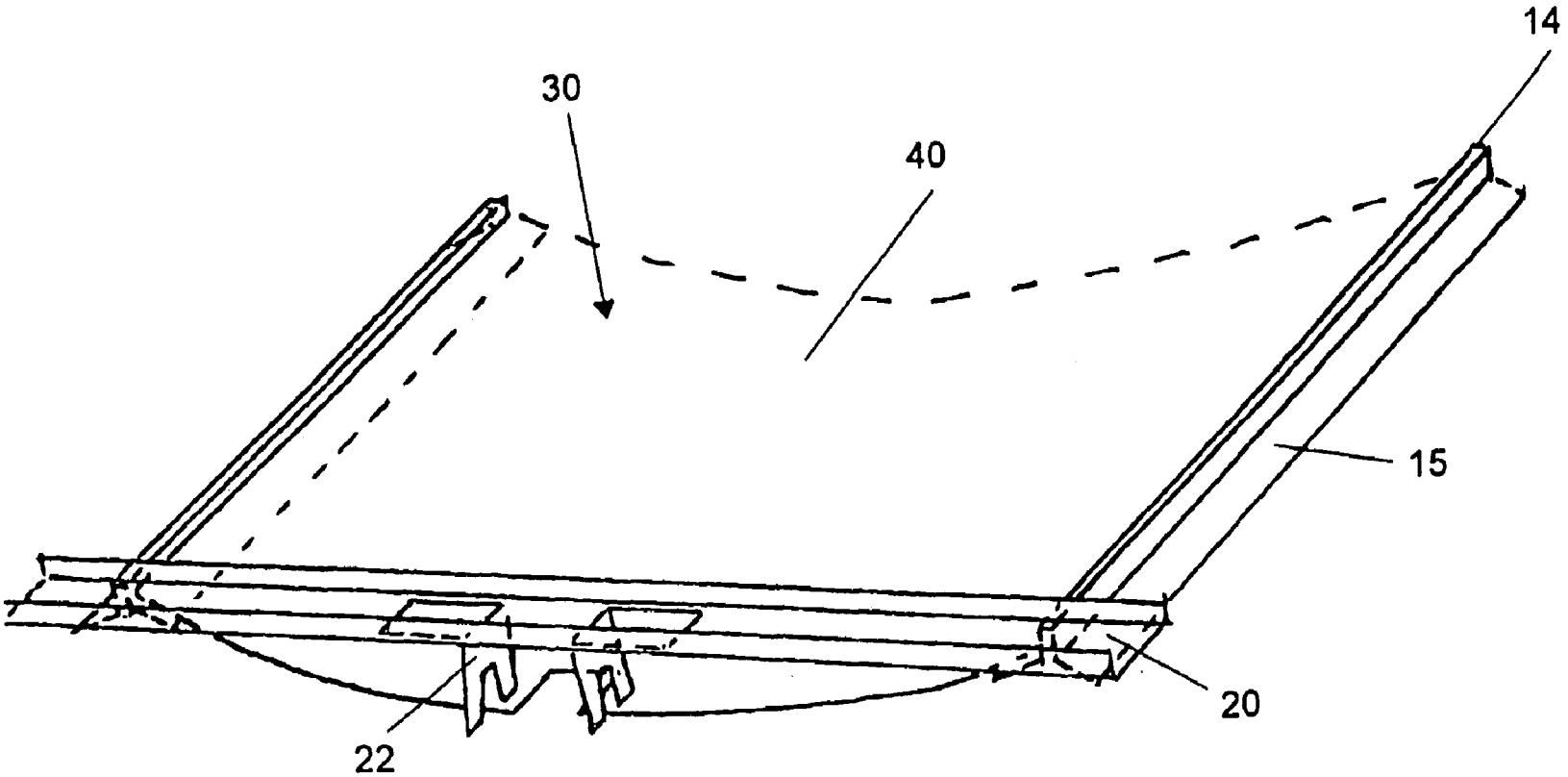
FIG. 6 shows an alternative embodiment of the ceiling structure.

FIG. 6 shows an alternative configuration of the ceiling structure, wherein, during the mounting, a downwards curvature is imparted to the sheets 30, the beams 14 having, on upwardly oriented faces, abutment areas 15 for the underside of the edge portions 50 of the sheets 30. The transverse beams 20 comprise force-transmitting means 22 in the form of downwardly-folded tongues that are formed by slitting up a part of the beams 20. The lower ends of the tongues 22 abut on the sheets 30 in the central portion 40 of the sheets.

Figure 7A:
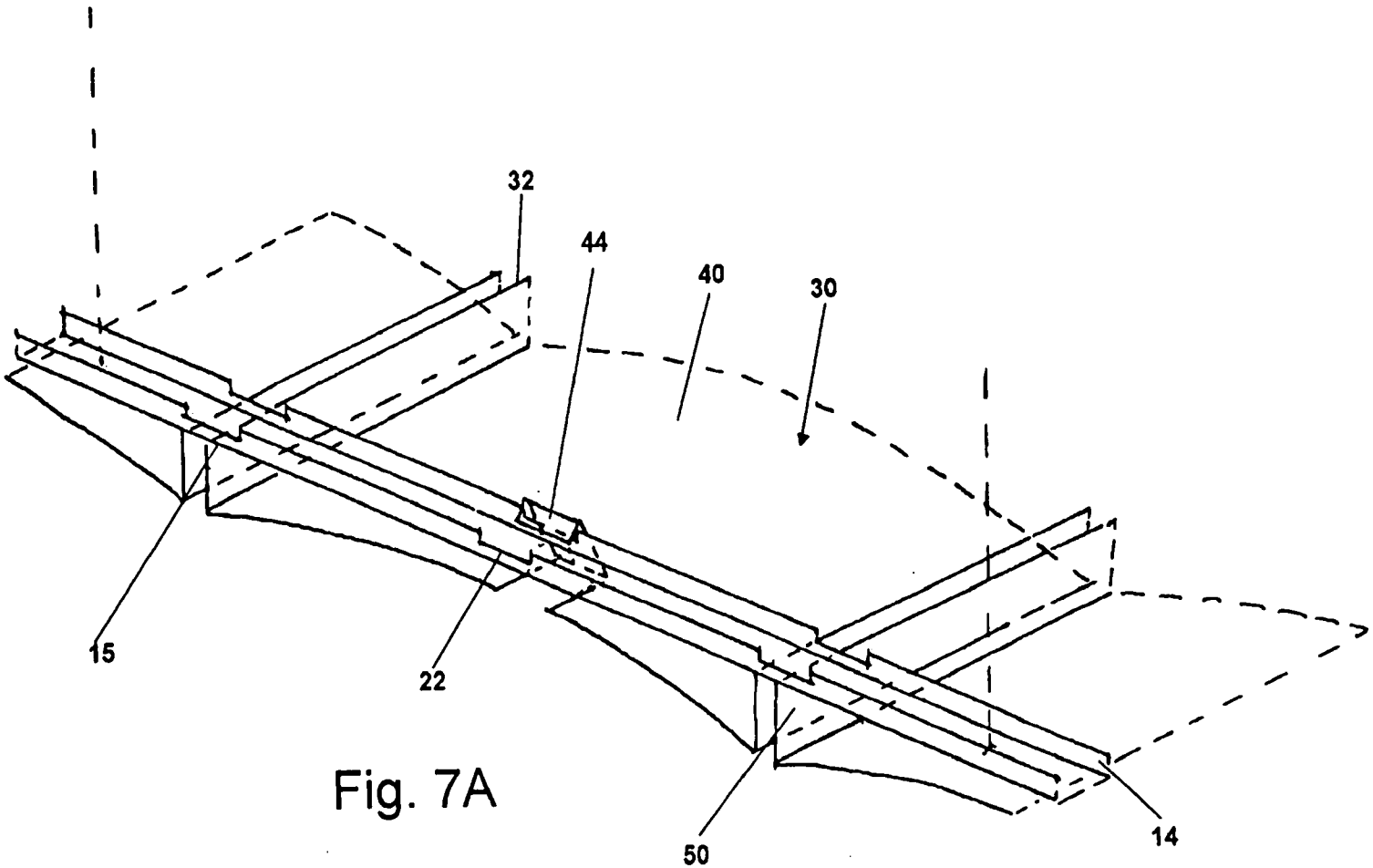
FIGS. 7A and 7B show further alternative embodiments of the ceiling structure.
Figure 7B:
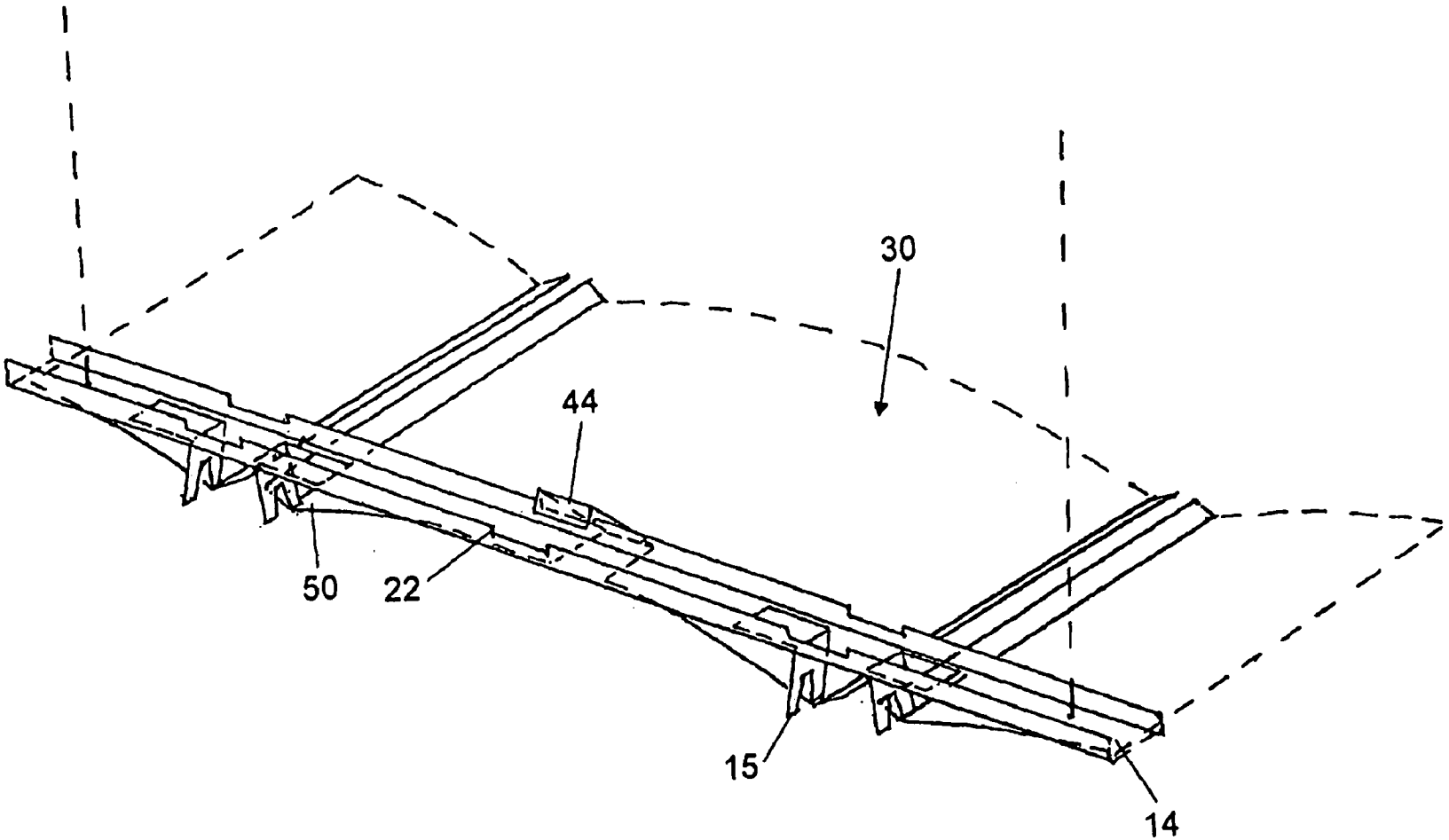

FIG. 7A shows yet another embodiment of the invention, wherein the force-transmitting means 22 are configured as integral parts of the beams 14, and wherein the sheets comprise upwardly folded edge portions 50 with end edges 32 that abut on abutment areas 15 on the underside of the beams 14. The force-transmitting means 22 cooperate, in this case, with parts 44 of the sheets that are arranged halfway between the edges 32 of the sheets 30. Conversely, FIG. 7B shows an alternative solution, in which the beam 14 has downwardly folded tongues that form the abutment areas 15 of the ceiling structure for the edge portions 50 of the sheets 30. The tongues abut on folding lines that delimit the central area 40 of the sheets 30, whereby stable bedding of the sheets 30 is accomplished.

Figures 8A, 8B, 8C:
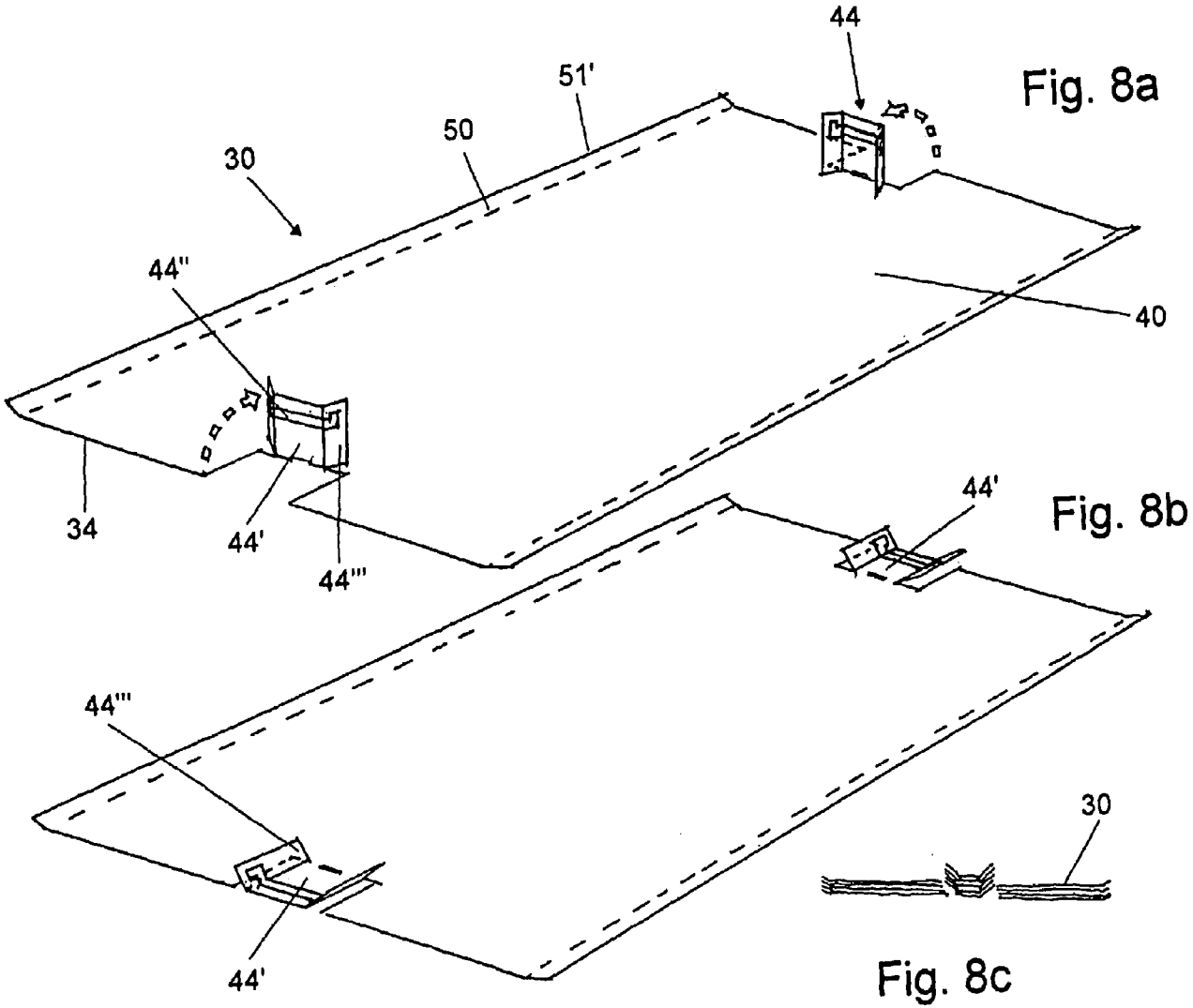
FIGS. 8A and 8B show an alternative embodiment of a sheet for forming the visible ceiling face, FIG. 8C showing a number of such sheets stacked on top of each other for allowing simple transport thereof.
Figures 9A, 9B:
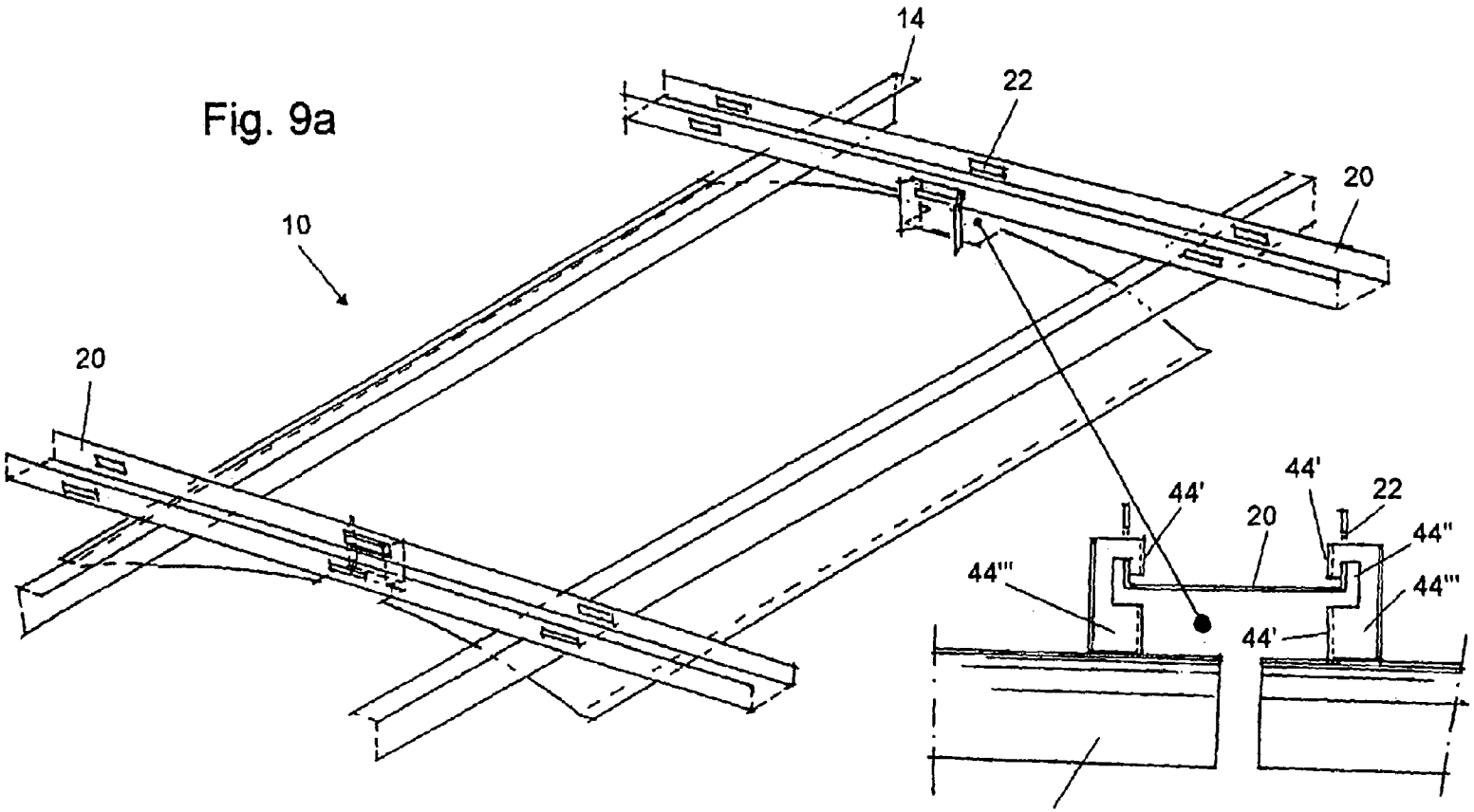
FIGS. 9A and 9B show the sheet shown in FIG. 8*a* mounted on carrier beams, FIG. 9A showing in enlarged scale the area in which the sheets is attached to a carrier beam, seen in a side view.

FIGS. 8A and 8B show an alternative configuration of a sheet 30 for use in combination with a series of intersecting beams 14, 20. The ceiling structure 10 with the sheet 30 shown in FIG. 8A is shown in FIGS. 9A and 9B. The ceiling structure shown in FIG. 9A corresponds in principle to the ceiling structure shown in FIG. 2. However, the sheet 30 shown in FIG. 9A has specially configured hook-like devices 44 that cooperate with force-transmitting means 22 configured with an elongate slot intended for receiving a respective hook-like device 44. Furthermore the sheet 30 has, viewed in the initial configuration shown in FIG. 8A, a centrally planar area 40 and is folded upwards along the outermost edges 51'. Hereby it is possible to provide a relatively close fitting between two adjacent sheets, either by the sheets 30 overlapping or by the outermost edges 51' of the sheets 30 abutting on each other. In principle, the mounting of the sheets 30 is accomplished in accordance with the teachings in relation to FIGS. 1, 2 and 3, since the hook-like devices have initially been folded to the position shown in FIG. 8A, in which the sheets 30 can easily be stacked as shown in FIG. 8C. The particular aspect of the embodiment shown in FIGS. 8A-C and 9A is the way in which the hook-like devices 44 are secured to the beams 20. The principle is shown in FIG. 9B, and it will appear that the hook-like devices 44 are configured as a cut out portion 44' of the sheet 30 and that this portion 44' is, during mounting of the sheet, folded upwards as shown by the arrow in FIG. 8A, the two side areas 44''' of the portion 44' having already been folded out of the plane of the portion 44'. The portion 44' comprises a cut-out slot 44'' that has a larger width in the side areas 44'''. Hereby a hook-like nose is formed that can be introduced through the slot 22, whose the dimension slightly exceeds the that of the hook-like nose. FIG. 9B shows how the hook-like nose is carried by the beam 20. As will appear, it is necessary to lift the sheet 30 a small distance upwards in order to be able to release the nose.

The invention claimed is:

1. A ceiling structure comprising:

a number of sheets that span between parallel beams mounted underneath a fixed ceiling;

wherein the sheets can, by elastic deformation, be taken from an initial configuration to a desired curved configuration in which the sheets are intended to form the visible ceiling face;

wherein the sheets have a first expanse along the beams and a transverse second expanse;

wherein the sheets along said first expanse have edge portions configured for abutting on abutment areas on the beams;

wherein the ceiling structure also comprises force-transmitting means that are configured for cooperating with portions of the sheets, which portions are arranged between said edge portions, in order to provide, in combination with the abutment force of the sheets against the abutment areas, the flexular moment necessary for maintaining the desired curved configuration of the sheets; and wherein the transverse second expanse is larger than the distance between the beams.

2. A ceiling structure comprising:

a number of sheets that span between parallel beams mounted underneath a fixed ceiling;

wherein the sheets can, by elastic deformation, be taken from an initial configuration to a desired curved configuration in which the sheets are intended to form the visible ceiling face;

wherein the sheets have a first expanse along the beams and a transverse second expanse;

wherein the sheets along said first expanse have edge portions configured for abutting on abutment areas on the beams;

wherein the ceiling structure also comprises force-transmitting means that are configured for cooperating with portions of the sheets, which portions are arranged between said edge portions, in order to provide, in combination with the abutment force of the sheets against the abutment areas, the flexular moment necessary for maintaining the desired curved configuration of the sheets;

wherein the transverse second expanse is larger than the distance between the beams; and wherein the force-transmitting means are arranged between the beams.

3. A ceiling structure according to claim 2, wherein the force-transmitting means are arranged essentially centrally between the beams in order to cooperate with portions of the sheets located centrally between said edge portions.

4. A ceiling structure according to claim 3, wherein the force-transmitting means are configured as a part of the beams.

5. A ceiling structure according to claim 4, wherein the sheets assume an essentially planar initial configuration.

6. A ceiling structure according to claim 5, wherein the sheets form an upwardly arching face in the curved configuration, wherein said abutment faces influence the sheets by a downwardly oriented force, while the force-transmitting means influence the sheets by an upwardly oriented force.

7. A ceiling structure according to claim 6, wherein a further system of parallel beams is provided, said beams being mounted underneath said fixed ceiling and comprising said force-transmitting means.

8. A ceiling structure according to claim 7, wherein the further system of parallel beams extends perpendicular to said first-mentioned parallel beams and are arranged above said abutment areas.

9. A ceiling structure according to claim 8, wherein the distance between the beams in the further system of parallel beams corresponds approximately to the first expanse of the sheets.

10. A ceiling structure according to claim 9, wherein the portions of the sheets that are arranged between said edge portions that cooperate with the force-transmitting means are arranged at the end edges of the sheets that extend in said transverse second expanse.

11. A ceiling structure according to claim 10, wherein the portions of the sheets that are arranged between said edge portions and cooperate with the force-transmitting means are configured as hook-like devices.

12. A ceiling structure according to claim 11, wherein the hook-like devices are integral parts of the sheets.

13. A ceiling structure according to claim 12, wherein the portions of the sheets that are arranged between said edge portions and cooperate with the force-transmitting means are configured as through-going openings in the sheets.

14. A ceiling structure according to claim 13, wherein the sheets, viewed in the initial configuration, comprises a centrally planar area with planar edge portions, said edge portions forming an angle relative to the central area.

15. A method of mounting a ceiling structure according to claim 14, wherein the edge portions of the sheets are first caused to abut on abutment areas on the beams; that the desired curvature is subsequently imparted to the sheets; and that the sheets are subsequently connected to said force-transmitting means.

* * * * *